US011166118B1

(12) United States Patent
Athayde et al.

(10) Patent No.: US 11,166,118 B1
(45) Date of Patent: Nov. 2, 2021

(54) MOBILE AWARE INTERMODAL ASSISTANT

(71) Applicant: Dell Products L.P., Round Rock, TX (US)

(72) Inventors: Felipe Goulart Athayde, São Paulo (BR); Eder Furtado Soares, Eusebio (BR); Francisco Carlos de Mattos Brito Oliveira, São Paulo (BR); Lidiane Castro Silva, São Paulo (BR); Robson dos Santos Sampaio, São Paulo (BR); Raizielle Ferreira Lima, São Paulo (BR); Nelson Alex Silva Lima, São Paulo (BR); João Isaac Silva Miranda, São Paulo (BR)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/856,732

(22) Filed: Apr. 23, 2020

(51) Int. Cl.
*H04R 29/00* (2006.01)

(52) U.S. Cl.
CPC ..... *H04R 29/001* (2013.01); *H04R 29/008* (2013.01); *H04R 2410/01* (2013.01)

(58) Field of Classification Search
CPC .... H04R 29/00; H04R 29/001; H04R 29/002; H04R 2410/01; H04R 29/008
USPC ..... 381/56–59
See application file for complete search history.

(56) References Cited

U.S. PATENT DOCUMENTS

| | | | | |
|---|---|---|---|---|
| 8,731,206 | B1 * | 5/2014 | Park | H04R 29/001 381/59 |
| 2007/0025563 | A1 * | 2/2007 | Wu | G01H 3/125 381/94.1 |
| 2013/0142346 | A1 * | 6/2013 | Yang | H04R 29/001 381/58 |
| 2014/0010379 | A1 * | 1/2014 | Wellman | H04R 29/00 381/58 |
| 2017/0286052 | A1 * | 10/2017 | Hartung | H04S 7/305 |
| 2017/0289717 | A1 * | 10/2017 | Little | G06F 3/165 |
| 2018/0343531 | A1 * | 11/2018 | Nomoto | H04R 1/406 |
| 2020/0359146 | A1 * | 11/2020 | Klinke | H04R 29/008 |

* cited by examiner

*Primary Examiner* — Disler Paul
(74) *Attorney, Agent, or Firm* — Terrile, Cannatti & Chambers; Stephen A. Terrile

(57) ABSTRACT

A system, method, and computer-readable medium are disclosed for performing an audio output detection operation. The audio detection operation includes: identifying a reference audio output associated with a manufacturing environment; calibrating a threshold noise level of the manufacturing environment; monitoring the manufacturing environment for an audio output above a predefined noise threshold; comparing the audio output above the predefined noise threshold with the reference audio output; and, present information associated with the audio output above the predefined noise threshold upon detection of a match between the audio output above the predefined noise threshold and the reference audio output.

20 Claims, 5 Drawing Sheets

MOBILE AWARE INTERMODAL ASSISTANT

BACKGROUND OF THE INVENTION

Field of the Invention

The present invention relates to information handling systems. More specifically, embodiments of the invention relate to detecting audio output from a device under test in a manufacturing environment.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

SUMMARY OF THE INVENTION

In one embodiment the invention relates to a method for performing an audio output detection operation, comprising: identifying a reference audio output associated with a manufacturing environment; calibrating a threshold noise level of the manufacturing environment; monitoring the manufacturing environment for an audio output above a predefined noise threshold; comparing the audio output above the predefined noise threshold with the reference audio output; and, presenting information associated with the audio output above the predefined noise threshold upon detection of a match between the audio output above the predefined noise threshold and the reference audio output.

In another embodiment the invention relates to a system comprising: a processor; a data bus coupled to the processor; and a non-transitory, computer-readable storage medium embodying computer program code, the non-transitory, computer-readable storage medium being coupled to the data bus, the computer program code interacting with a plurality of computer operations and comprising instructions executable by the processor and configured for: identifying a reference audio output associated with a manufacturing environment; calibrating a threshold noise level of the manufacturing environment; monitoring the manufacturing environment for an audio output above a predefined noise threshold; comparing the audio output above the predefined noise threshold with the reference audio output; and, presenting information associated with the audio output above the predefined noise threshold upon detection of a match between the audio output above the predefined noise threshold and the reference audio output.

In another embodiment the invention relates to a computer-readable storage medium embodying computer program code, the computer program code comprising computer executable instructions configured for: identifying a reference audio output associated with a manufacturing environment; calibrating a threshold noise level of the manufacturing environment; monitoring the manufacturing environment for an audio output above a predefined noise threshold; comparing the audio output above the predefined noise threshold with the reference audio output; and, presenting information associated with the audio output above the predefined noise threshold upon detection of a match between the audio output above the predefined noise threshold and the reference audio output.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
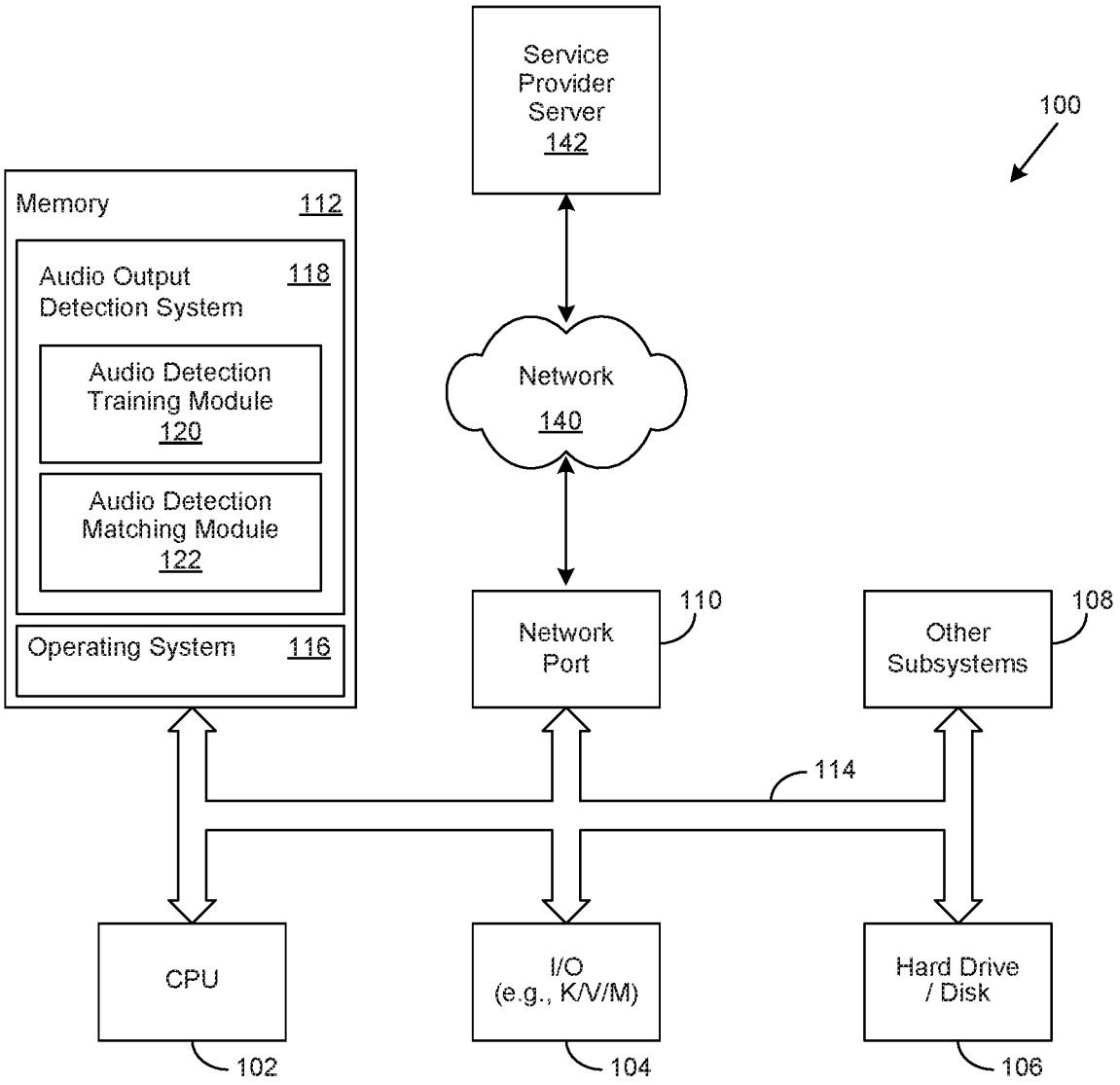
FIG. 1 shows a general illustration of components of an information handling system as implemented in the system and method of the present invention.

A system, method, and computer-readable medium are disclosed for detecting audio output from a device under test in a manufacturing environment. Certain aspects of the invention reflect an appreciation that ambient noise levels in a manufacturing environment are often high. Conveyor belts and carts clattering as they move sub-assemblies, power tools being used to assemble components, and employees having conversations amongst themselves can all add to a high level of background noise. Furthermore, such background sound levels are typically not constant. Instead, they ebb and flow with the normal routine of a manufacturing environment.

Various aspects of the invention likewise reflect an appreciation that certain manufacturing operations, procedures, and processes may involve testing the audio output of a device under test. Likewise, certain aspects of the invention reflect an appreciation that detecting the presence of such an audio out over ambient background noise may prove challenging. Furthermore, certain aspects of the invention reflect an appreciation that discerning the quality of such an audio output may be equally challenging if it is detected. Moreover, certain aspects of the invention reflect an appreciation that detecting such audio output may prove especially challenging if the person conducting an audio output test is hearing impaired.

Various aspects of the invention reflect an appreciation that certain voice recognition approaches are well known. However, certain aspects of the invention likewise reflect an appreciation that such approaches are typically not oriented towards filtering out ambient background noise. Likewise, certain aspects of the invention reflect an appreciation that voice recognition approaches that do provide such filtering capabilities are generally unable to do so on a dynamic basis as the ambient noise changes in characteristics and volume. Certain aspects of the invention reflect an appreciation that known voice recognition approaches are likewise unable to assign text or numbers to a particular sound. As an example, an audio output that is a 1,000 kHz tone may simply be referenced as "sound" instead of being able to provide its associated frequency in a combination of numbers and text.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

FIG. 1 is a generalized illustration of an information handling system 100 that can be used to implement the system and method of the present invention. The information handling system 100 includes a processor (e.g., central processor unit or "CPU") 102, input/output (I/O) devices 104, such as a display, a keyboard, a mouse, a touchpad or touchscreen, and associated controllers, a hard drive or disk storage 106, and various other subsystems 108. In various embodiments, the information handling system 100 also includes network port 110 operable to connect to a network 140, which is likewise accessible by a service provider server 142. The information handling system 100 likewise includes system memory 112, which is interconnected to the foregoing via one or more buses 114. System memory 112 further comprises operating system (OS) 116 and in various embodiments may also comprise an audio output detection system 118. In certain embodiments, the information handling system 100 may be implemented to download the audio output detection system 118 from the service provider server 142.

In certain embodiments, the audio output detection system 118 may be provided as a service from the service provider server 142. In certain embodiments, the audio output detection system 118 may be implemented to include an audio detection training 120 module, or an audio detection matching 122 module, or both. In certain embodiments, the audio output detection system 118 may be implemented to perform an audio output detection operation. In certain embodiments, the audio output detection operation may be performed in a manufacturing environment, described in greater detail herein, during operation of an information handling system 100.

Figure 2:
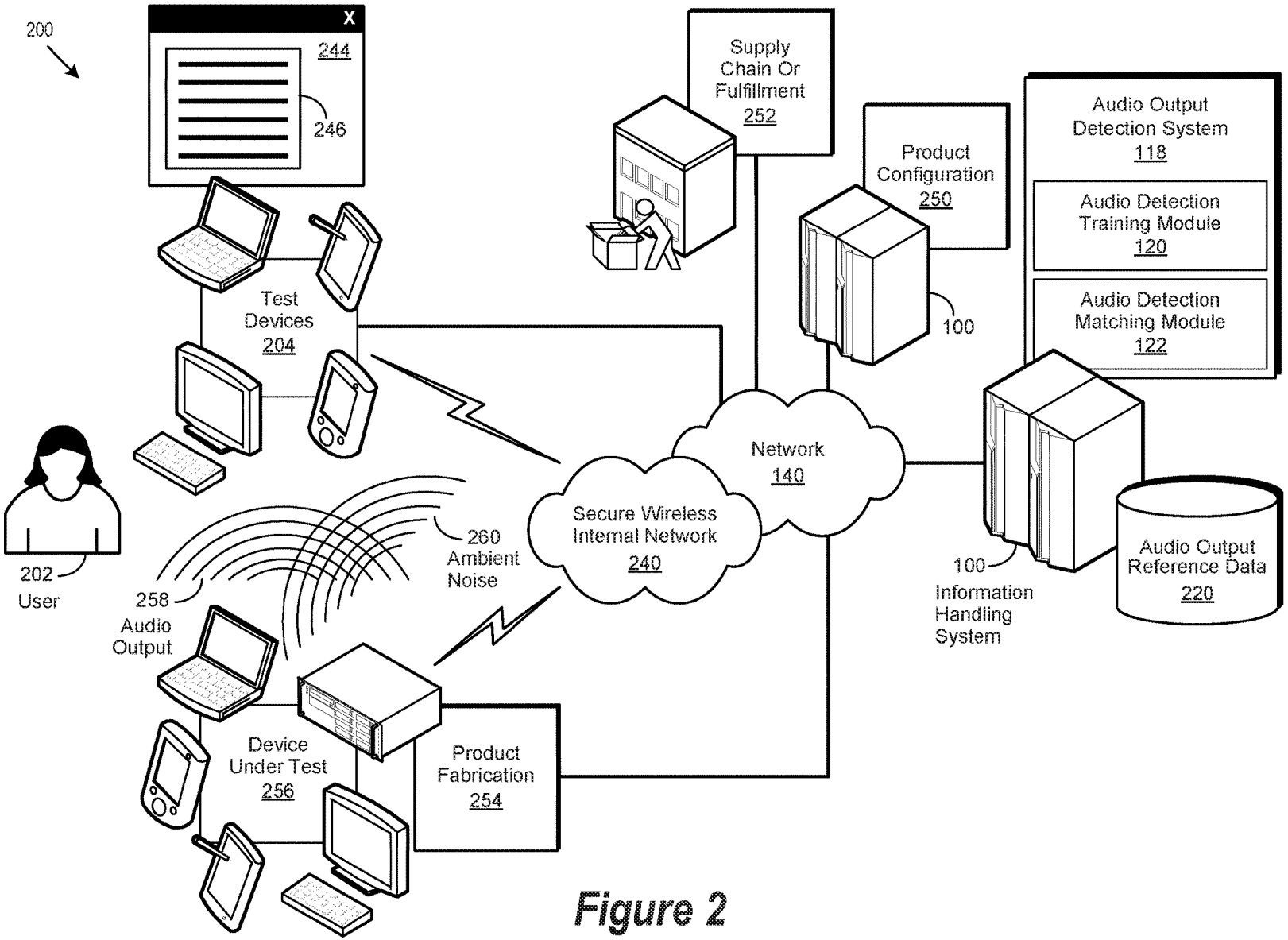
FIG. 2 shows a block diagram of a manufacturing environment.

FIG. 2 shows a block diagram of a manufacturing environment implemented in accordance with an embodiment of the invention. In certain embodiments, the manufacturing environment 200 may include an audio output detection system 118, a repository of audio output reference data 220, or both. In certain embodiments, the audio output detection system 118 may include an audio detection training 120 module, or an audio detection matching 122 module, or both. In certain embodiments, the repository of audio output reference data 220 may be local to the information handling system 100 executing the audio output detection system 118, or it may be accessed remotely.

In various embodiments, the audio output detection system 118 may be implemented to perform certain operations associated with detecting the presence of an audio output 258 emitted by a particular device under test 256 in a manufacturing environment 200. As used herein, an audio output 258 broadly refers to an audible sound emitted by a device under test 256 as a result of an audio output test operation, procedure, or process. In various embodiments, the purpose of such an audio output test operation, procedure, or process is to determine the ability of a particular device under test 256 to emit an audio output 258 according to certain predetermined criteria, or parameters, or both.

In certain embodiments, the audio output 258 may be emitted by a device under test 256 as a single frequency sound. In certain embodiments, the audio output 258 may be emitted as a sound that includes multiple frequencies, such as a chord. In certain embodiments, the audio output 258 may be emitted as a sound whose frequency varies, ranging from a lower frequency (e.g., 20 Hz.) to an upper bound (e.g., 20,000 Hz). In certain embodiments, the variation may vary from the lower frequency to the higher frequency once, or multiple times, or across portions of the sound spectrum defined by the lower and higher frequency, or a combination thereof.

In certain embodiments, the audio output 258 may be emitted as a sequence of single, or multiple frequency, sounds, such as a musical tune or song. In certain embodiments, the audio output 258 may be emitted as one or more spoken words. In certain embodiments, the audio output 258 may be emitted by a combination of two or more audio outputs 258. Those of skill in the art will recognize that many such embodiments of an audio output are possible. Accordingly, the foregoing is not intended to limit the spirit, scope, or intent of the invention.

As likewise used herein, a device under test 256 broadly refers to any device, such as an information handling system 100, radio, stereo receiver, television, toy, and so forth, operable to emit an audio output 258. In certain embodiments, an electroacoustic transducer, such as a loudspeaker, may be implemented with the device under test 256 to emit the audio output 258. In certain embodiments, the electroacoustic transducer may be implemented to be internal or external to the device under test 256.

In various embodiments, the audio output deduction system 118 may be implemented to detect the presence of a particular audio output 258 in the presence of certain ambient noise 260. As used herein, ambient noise 260, also commonly referred to as ambient noise level or background noise, broadly refers to a background sound pressure level at a particular location, such as a manufacturing environment 200. In certain embodiments, the ambient noise 260 noise at a particular location (e.g., a manufacturing environment 200), at a particular time (e.g., during a manufacturing production run), for a particular set of factors (e.g., for a particular class of products), may be used as a reference level to evaluate a new sound, such as an audio output 258.

In certain embodiments, an audio output 258 emitted by a particular device under test 256 may be received, and captured, by a test device 204. As used herein, a test device 204 broadly refers to an information handling system configured to receive and capture an audio output 258 emitted by a device under test 256, processing data related thereto, communicating such data to the audio output detection system 118, and receiving a response therefrom. Examples of such test devices 204 include a personal computer, a laptop computer, a tablet computer, a personal digital assistant (PDA), a smart phone, a mobile telephone, a purpose-built test device, or any other device configured to receive, capture, process, and communicate an audio output 258, and receive a response related thereto.

In certain embodiments, the occurrence of a particular audio output 258, or ambient noise 260, or both, may be received by a transducer, such as a microphone, associated with a test device 204. In certain embodiments, a transducer associated with a particular test device 204 may be implemented to convert the audio output 258 into an electrical signal. In certain embodiments, a test device 204 may be implemented to retain a copy of a particular captured audio output 258 as an electrical signal. In various embodiments, the electrical signal may be retained in a digital format. In these embodiments, the digital format selected to retain an electrical signal associated with a particular audio output 258 is a matter of design choice.

In certain embodiments, the test device 204 may be implemented to provide a particular captured audio output 258 to the audio output detection system 118 as a reference audio output 258. In certain embodiments, the test device may be implemented to provide the reference audio output to the audio output detection system 118 in a digital format. As used herein, a reference audio output 258 broadly refers to an audio output 258 emitted by an associated device under test 256 in the absence of ambient noise 260. In certain embodiments, the audio output detection system 118 may be implemented to provide a reference audio output 258 it receives from a test device 204 to the audio detection training module 120.

In various embodiments, the audio detection training module 120 may be implemented to associate the reference audio output 258 with certain data and metadata related to the device under test 256 from which it was emitted. In certain embodiments, the reference audio output 258, and data and metadata related to its associated device under test 256, may be stored in the repository of audio output reference data 220. In various embodiments, certain reference audio outputs 258, and their associated data and metadata, stored in the repository of test audio reference audio may be used to train the audio detection matching 122 module such that it recognizes a particular detected audio output 258 emitted by an associated device under test 256, as described in greater detail herein.

In certain embodiments, the test device 204 may be implemented to provide a captured audio output 258 to the audio output detection system 118 as a non-reference audio output 258. As used herein, a non-reference audio output 258 broadly refers to an audio output 258 emitted by an associated device under test 256 that includes ambient noise 260. In certain embodiments, the audio detection matching module 122 may be implemented to generate a detected audio output 258 by processing a non-reference audio output 258 received from a test device 204 to filter, or otherwise remove, any ambient noise 260 it may contain. Accordingly, as used herein, a detected audio output 258 broadly refers to a non-reference audio output 258 that has been processed to remove any associated ambient noise 260.

In various embodiments, the audio detection matching module 122 may be implemented to generate an audio output detection response as a result of comparing a detected audio output 258 to one or more reference audio outputs 258 stored in the repository of audio output reference data 220. In certain embodiments, the response may be implemented to indicate whether the detected audio output 258 matches one or more reference audio output 258 stored in the repository of audio test signal data. In certain embodiments, the audio detection matching module 122 may be implemented to provide the audio output detection response to the test device 204 that provided a corresponding non-reference audio output 258.

In various embodiments, the audio output detection system 118 may be implemented to use one or more networks 140, such as a secure wireless internal network 240 to exchange certain audio output 258 information with a particular test device 204, a particular device under test 256, or a combination of the two. In various embodiments, the network 140 may be a public network 140, such as the Internet, a physical private network 140, a secure wireless internal network 240, a virtual private network (VPN) 140, or any combination thereof. In certain embodiments, the combination of the test device 204, or the device under test 256, or both, and the secure wireless internal network 240, by itself, or in combination with a particular network 140, may be implemented as a mobile communications environment within the manufacturing environment 200. In certain embodiments, the secure wireless internal network 240 may include a personal area network (PAN), based on technologies such as Bluetooth or Ultra Wideband (UWB). In certain embodiments, the secure wireless internal network 240 may include a wireless local area network (WLAN), based on variations of the IEEE 802.11 specification, often referred to as WiFi.

In certain embodiments, the secure wireless internal network 240 may include a wireless wide area network (WWAN) based on an industry standard including two and a half generation (2.5G) wireless technologies such as global system for mobile communications (GPRS) and enhanced data rates for GSM evolution (EDGE). In certain embodiments, the secure wireless internal network 240 may include WWANs based on existing third generation (3G) wireless technologies including universal mobile telecommunications system (UMTS) and wideband code division multiple access (W-CDMA). In certain embodiments, the secure wireless internal network 240 may include the implementation of other 3G technologies, including evolution-data optimized (EVDO), IEEE 802.16 (WiMAX), wireless broadband (WiBro), high-speed downlink packet access (HSDPA), high-speed uplink packet access (HSUPA), and emerging fourth generation (4G) and fifth generation (5G) wireless technologies. Skilled practitioners of the art will realize that many such embodiments are possible and the foregoing is not intended to limit the spirit, scope or intent of the invention.

In certain embodiments, the test device 204 may be configured to present a user interface (UI) 244 associated with the audio output detection system 118. In certain embodiments, the UI 244 may be implemented to present a graphical representation 246 of information associated with the execution of certain audio output detection operations, described in greater detail herein. In certain embodiments, the graphical representation 246 may be automatically generated in response to an interaction between the audio output detection system 118, the test device 204, a particular device under test 256, or a combination thereof. In certain embodiments, the user device 204 may be implemented to exchange information between a user 202, a particular device under test 256, the audio output detection system 118, a product configuration system 250, a supply chain or fulfillment system 252, a product fabrication system 254, or a combination thereof. As described in greater detail herein, the exchange of such information may be accomplished in certain embodiments through the use of the secure wireless internal network 240, independently or in combination with, another network 140.

In certain embodiments, the audio output detection system 118 may be implemented to interact with a particular test device 204, the product configuration system 250, the supply chain or fulfillment system 252, the product fabrication system 254, one or more devices under test 256, or a combination thereof. In certain embodiments, the test device 204, the product configuration system 250, the supply chain or fulfillment system 252, and the product fabrication system 254 may be executing on separate information handling systems 100. In certain embodiments, the product configuration system 250 may be implemented to interact with the product fabrication system 254. In various embodiments, the product fabrication system 254 may be implemented to interact with one or more devices under test 256. In various embodiments, such interactions may be used by the product fabrication system 254 in the performance of certain fabrication activities, operations, or processes known to those of skill in the art.

Figure 3:
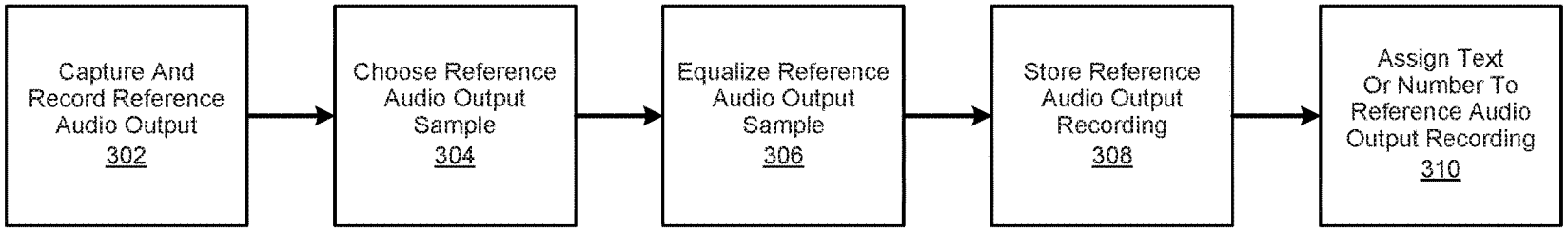
FIG. 3 shows a simplified process flow diagram of the performance of audio output detection training operations.

FIG. 3 shows a simplified process flow diagram of the performance of audio output detection training operations implemented in accordance with an embodiment of the invention. In this embodiment, as described in greater detail herein, a device under test may be implemented to produce a particular audio output in the absence of ambient noise to generate a reference audio output. In step 302, a user may be prompted in certain embodiments to record, and store, the resulting reference audio output multiple times (e.g., three times) within a particular time interval (e.g. 30 seconds) to generate samples of the reference audio output.

In certain embodiments, the samples of the reference audio output may be saved in a digital format, such as a Moving Picture Expert Group) MPEG file. In certain embodiments, the samples of the reference audio output, with associated data and metadata, may be stored in a repository of reference audio output data. In certain embodiments, the data and metadata associated with a particular reference audio output sample may be related to the device that emitted the reference audio output, its model and serial number, time and date, operator, manufacturing facility, and so forth.

The resulting reference audio output samples may then be processed in step 304 by an audio output recognition algorithm to determine the best sample. The method by which a particular reference audio output sample is determined to be best is a matter of design choice. As an example, three samples may be identical, with no extraneous ambient noise. In this example, any of the three samples may be selected. As another example, two of three samples may contain some degree of extraneous ambient noise. In this example, the sample containing no extraneous ambient noise may be selected as the best sample.

In turn, the selected reference audio output sample may then be automatically edited in step 306, by removing its edges and normalizing, leaving only the desired sound wave, to generate an equalized reference audio output sample. Then, in step 308, the resulting reference audio output sample may be stored in a repository of reference audio output data as a reference audio output data. In certain embodiments, data and metadata may be associated with the stored reference audio output in step 310.

In certain embodiments, the data and metadata may be related to the device under test that originally emitted the reference audio output. In certain embodiments, the data and metadata may be related to certain attributes of the audio output, such as its associated frequencies, whether it is one or more spoken words, and so forth. In certain embodiments, the data and metadata may be in the form of text, numbers, or a combination thereof. In certain embodiments, the data and metadata may be provided to a particular test device, where it may be displayed within an associated user interface (UI), as described in greater detail herein.

Figure 4:
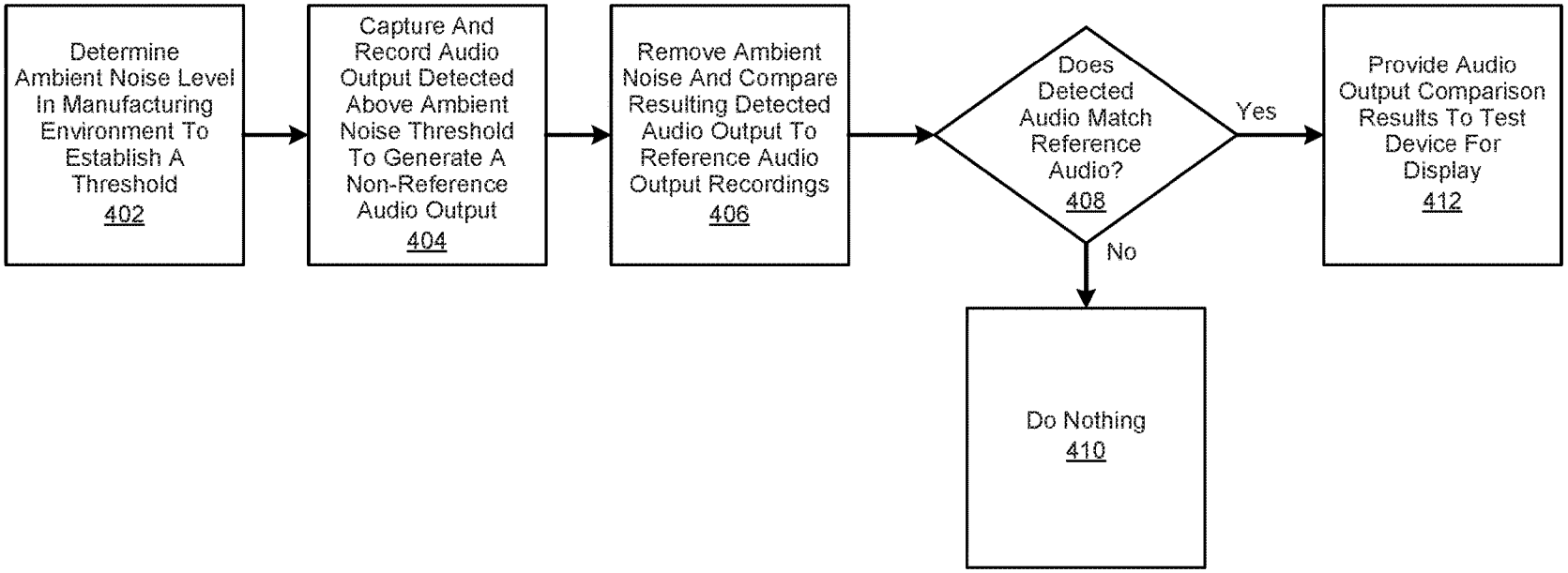
FIG. 4 shows a simplified process flow diagram of the performance of audio output detection and matching operations.

FIG. 4 shows a simplified process flow diagram of the performance of audio output detection and matching operations implemented in accordance with an embodiment of the invention. In this embodiment, sound pressure level (SPL) readings of ambient noise present in a manufacturing environment are made in step 402 to establish an ambient noise threshold level. Certain embodiments of the invention reflect an appreciation that the ambient SPL may vary greatly within a particular manufacturing environment according to the time of day, the location the SPL measurement is made, the manufacturing process currently taking place, associated manufacturing activities, and so forth. Accordingly, in certain embodiments, an ambient noise SPL measurement may be made shortly (e.g., one to five seconds) prior to testing the audio output of a particular device under test to establish the ambient noise threshold level. In these embodiments, the amount of time prior to testing the audio output of a particular device under test, the location, the frequency, and the duration of such ambient noise SPL measurements are a matter of design choice.

In step 402, the audio output emitted by a particular device under test is captured and recorded. In certain embodiments, the SPL of the audio output may be above the ambient noise threshold at the time the audio output is captured and recorded. In various embodiments, the audio output may be automatically captured and recorded whenever its SPL is above a particular ambient noise threshold. In certain of these embodiments, the ambient noise threshold may be set automatically, manually, or a combination thereof.

In various embodiments, the capture and recording of the audio output emitted by a particular device under test may be initiated by the execution of an associated audio output test operation, procedure, or process. In certain of these embodiments, the execution of the associated audio output test operation, procedure, or process may be initiated automatically, manually, or a combination thereof. In certain embodiments, a captured and recorded audio output emitted by a particular device under test may likewise be processed in step 402 to generate a non-reference audio output, described in greater detail herein.

Then, in step 404, the resulting non-reference audio output is processed to remove any ambient noise it may contain, to generate a detected audio output. In certain embodiments, a matched filter may be implemented to remove, or disregard, the ambient noise associated with the non-reference audio output. Those of skill in the art will be familiar with matched filters, which are obtained in signal processing by correlating a known pattern, or model, with an unknown signal to detect the presence of the model in the unknown signal.

As typically implemented, matched filters are equivalent to convoluting an unknown signal with a reverse-time conjugated version of a known model. Accordingly, a matched filter has the characteristic of being able to maximize the signal-to-noise ratio (SNR) in an unknown signal that contains additive stochastic noise and is commonly used to detect signals in a noisy environment. Skilled practitioners of the art will be knowledgeable of other approaches to removing, or disregarding, ambient noise associated with a particular non-reference audio output. Accordingly, the foregoing is not intended to limit the spirit, scope, or intent of the invention.

Comparison operations are then performed in step 406 to compare the resulting detected audio output to previously stored reference audio outputs to determine whether there is a match. In various embodiments, one or more voice activity detection algorithm (VADs), known to those of skill in the art, may be implemented to detect the presence or absence of certain speech components in the detected audio output. In various embodiments, an adaptive VAD model, based upon signal energy and variance, may be implemented to provide classification of segments of speech and silence within a particular detected audio output. In certain of these embodiments, the VAD algorithm may be implemented to create a filter that corresponds to patterns detected by a particular matched filter, described in greater detail herein.

A determination is then made in step 408 whether the detected audio output generated in step 406 matches a reference audio output previously stored in a repository of reference audio output data. If not, then nothing further is done in step 410. However, if there is a match, then data and metadata associated with the matching reference audio output is provided to the test device for display in step 412. In certain embodiments, the data and metadata may include text, numeric data, one or more graphical elements, or a combination thereof.

Figure 5:
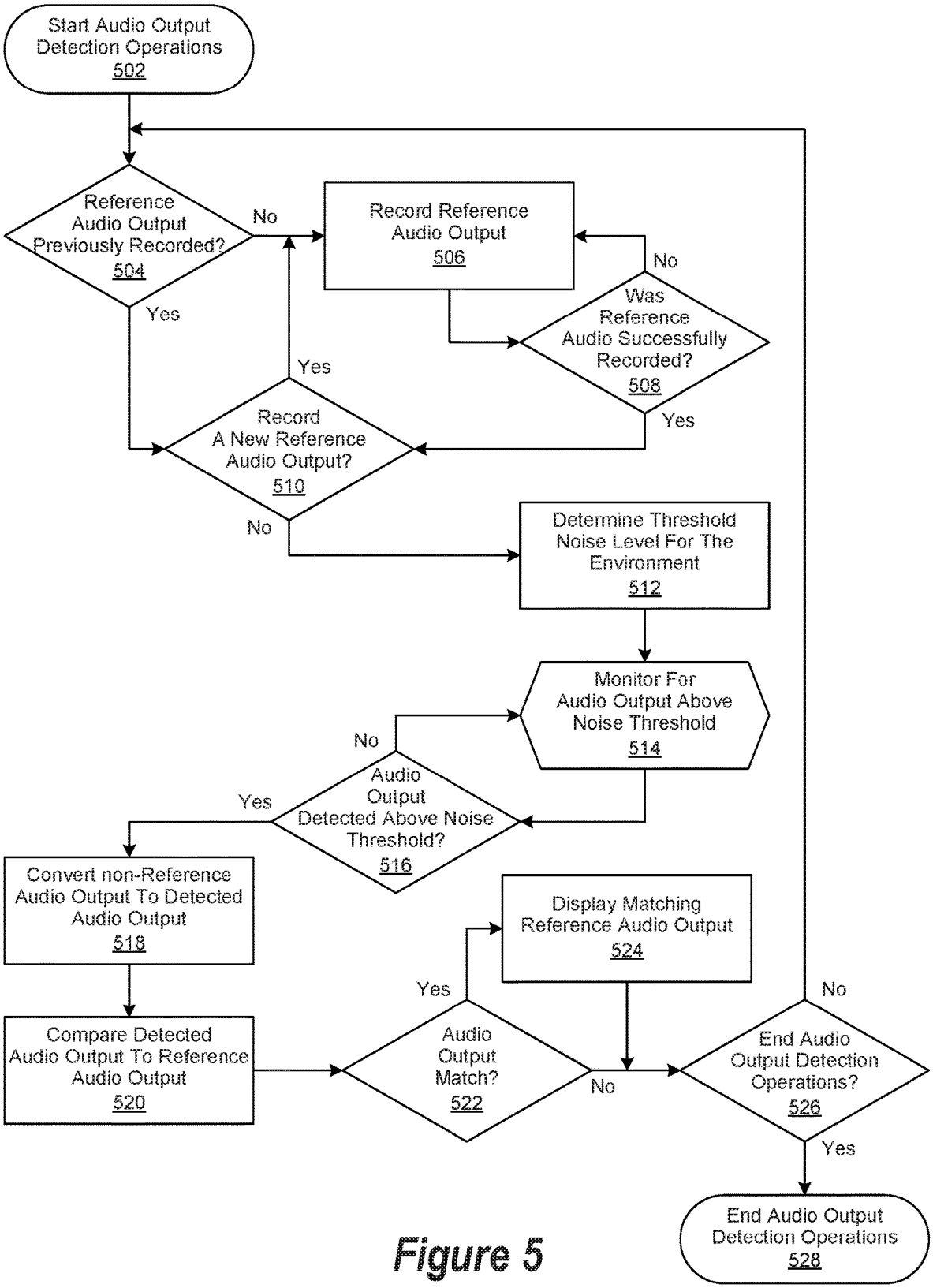
FIG. 5 shows a flow chart of audio output detection operations.

FIG. 5 shows a flow chart of audio output detection operations implemented in accordance with an embodiment of the invention. In this embodiment, audio output detection operations are begun in step 502, followed by a determination being made in step 504 whether a reference audio output, described in greater detail herein, has been previously recorded and stored in a repository of reference audio output data. If not, then a reference audio output is recorded in step 506, as likewise described in greater detail herein.

A determination is then made in step 508 whether the reference audio output was successfully recorded and stored in step 506. If not, then the process is continued, proceeding with step 506. Thereafter, or if it was determined in step 504 that a reference audio output has been previously recorded and stored, then a determination is made in step 510 whether to record and store an additional reference audio output. If so, then the process is continued, proceeding with step 506. Otherwise, a threshold ambient noise level for the manufacturing environment is determined in step 512, as described in greater detail herein.

Ongoing operations are then begun in step 514 to monitor for an audio output emitted by a device under test whose sound pressure level (SPL) is above the previously determined ambient noise threshold. A determination is then made in step 516 whether an audio output has been detected above the ambient noise threshold. If not, the process is continued, proceeding with step 514. Otherwise, the non-reference audio output detected in step 514 is captured, recorded, and converted, as described in greater detail herein, into a detected audio output in step 518.

The resulting detected audio output is then compared in step 520 to reference audio outputs stored in a repository of reference audio output data, as likewise described in greater detail herein. A determination is then made in step 522 whether the detected audio output matches a reference audio output. If so, then data and metadata associated with the matching reference audio output is provided in step 514 to a test device, where it is displayed within a user interface (UI). Otherwise, or after the data and metadata associated with the matching reference audio output is provided to the test device for display, a determination is made in step 526 whether to end audio output detection operations. If not, the process is continued, proceeding with step 504. Otherwise audio output detection operations are ended in step 528.

Figure 6:
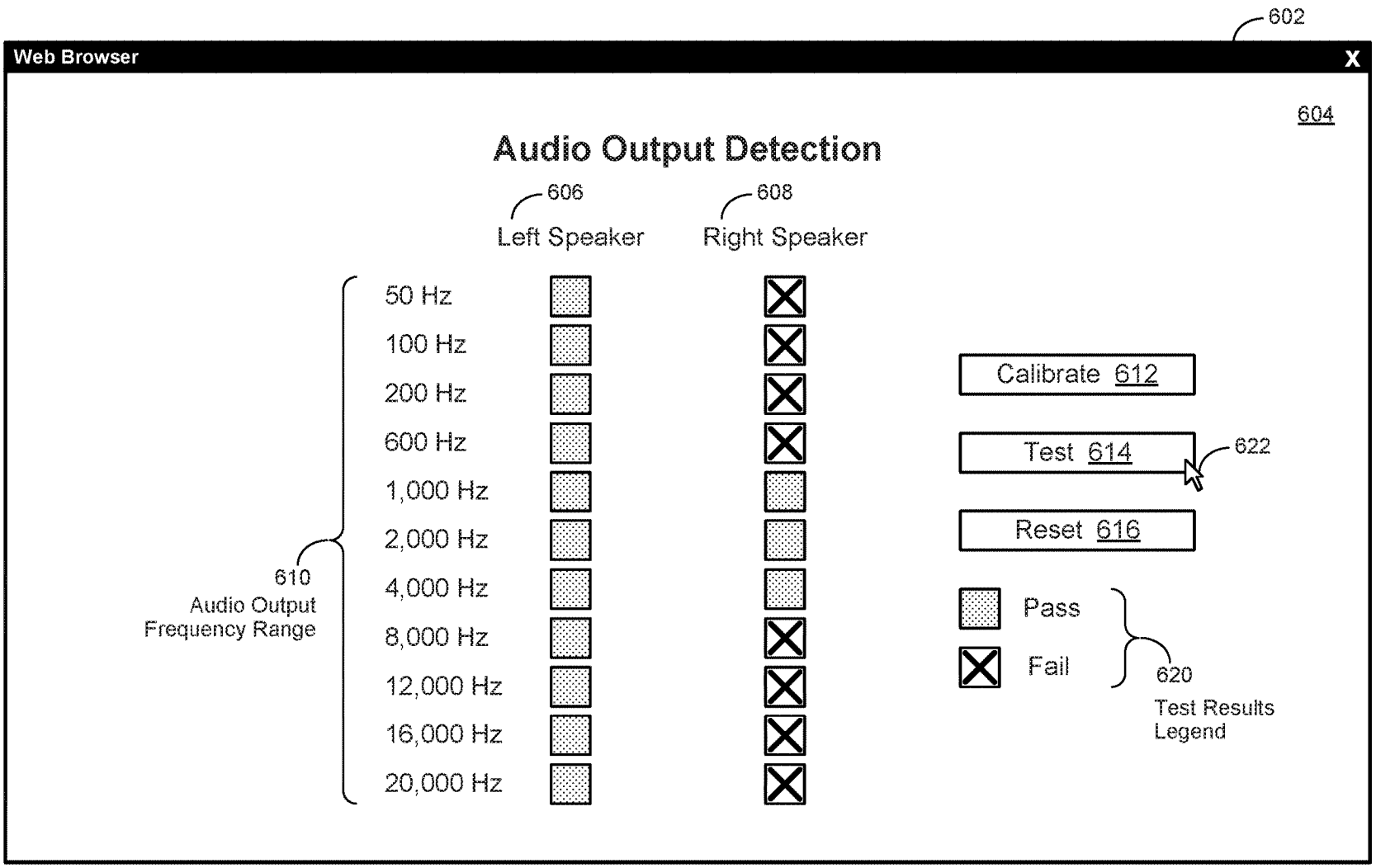
FIG. 6 shows an example screen presentation of an audio output detection system user interface.

FIG. 6 shows an example screen presentation of an audio output detection system user interface implemented in accordance with an embodiment of the invention. In this embodiment, data and metadata associated with one or more reference audio outputs, described in greater detail herein, is displayed within a window 604 of a user interface (UI) 602, such as a web browser, associated with a test device. In certain embodiments, the data and metadata may include numbers, text, graphical elements, or a combination thereof, to provide the results of one or more audio output tests conducted on a device under test, described in greater detail herein.

For example, as shown in FIG. 6, the audio output test may be conducted on a laptop computer that includes a left 606 and right 608 speaker. In this example, the audio output frequency range 610 of both the left 606 and right 608 speaker may be tested in a manufacturing environment that includes ambient noise, as described in greater detail herein. To continue the example, the audio test is reset by selecting the "Reset" 618 button within the UI window 604 through a user gesture, such as a mouse click associated with a pointer 622. Next, the ambient noise of the manufacturing environment is measured by selecting the "Calibrate" 612 button, followed by selecting the "Test" button to initiate the one or more audio output tests.

To further continue the example, the test results 620 of the one or more audio output tests indicate that the left 606 speaker operate properly across its associated audio output frequency range 610. However, the test results 620 of the one or more audio output tests likewise indicate that the right 608 speaker fails to operate properly across its associated audio output frequency range 610. More specifically, the test results 620 indicate the right 608 speaker fails to operate properly between 50 Hz and 600 Hz, and likewise fails to operate properly between 8,000 Hz and 20,000 Hz. Skilled practitioners of the art will recognize that many such embodiments and examples are possible. Accordingly, the foregoing is not intended to limit the spirit, scope, or intent of the invention.

As will be appreciated by one skilled in the art, the present invention may be embodied as a method, system, or computer program product. Accordingly, embodiments of the invention may be implemented entirely in hardware, entirely in software (including firmware, resident software, microcode, etc.) or in an embodiment combining software and hardware. These various embodiments may all generally be referred to herein as a "circuit," "module," or "system." Furthermore, the present invention may take the form of a computer program product on a computer-usable storage medium having computer-usable program code embodied in the medium.

Any suitable computer usable or computer readable medium may be utilized. The computer-usable or computer-readable medium may be, for example, but not limited to, an electronic, magnetic, optical, electromagnetic, infrared, or semiconductor system, apparatus, or device. More specific examples (a non-exhaustive list) of the computer-readable medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, or a magnetic storage device. In the context of this document, a computer-usable or computer-readable medium may be any medium that can contain, store, communicate, or transport the program for use by or in connection with the instruction execution system, apparatus, or device.

Computer program code for carrying out operations of the present invention may be written in an object oriented programming language such as Java, Smalltalk, C++ or the like. However, the computer program code for carrying out operations of the present invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

Embodiments of the invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

Consequently, the invention is intended to be limited only by the spirit and scope of the appended claims, giving full cognizance to equivalents in all respects.

What is claimed is:

1. A computer-implementable method for performing an audio output detection operation, comprising:

identifying a reference audio output associated with a manufacturing environment;

calibrating a threshold noise level of the manufacturing environment;

monitoring the manufacturing environment for an audio output above a predefined noise threshold, the audio output above the predefined noise threshold being generated by a device under test, the device under test being manufactured within the manufacturing environment;

comparing the audio output above the predefined noise threshold with the reference audio output; and, presenting information associated with the audio output above the predefined noise threshold upon detection of a match between the audio output above the predefined noise threshold and the reference audio output, the information associated with the audio output providing an indication of whether the device under test has an ability to emit an audio output according to predetermined criteria, the presenting being via a user interface, the user interface presenting a graphical representation of the indication of whether the device under test has the ability to emit the audio output according to the predetermined criteria.

2. The method of claim 1, wherein:

the identifying the reference audio output comprises recording a reference audio output; and, selecting a reference audio output sample from the reference audio output.

3. The method of claim 2, wherein:

the identifying the reference audio output comprises assigning a value to the reference audio output.

4. The method of claim 1, wherein:

the information associated with the audio output is presented via an audio output detection system user interface.

5. The method of claim 1, wherein:

the device under test comprises a right speaker and a left speaker; and, the indication of whether the device under test has the ability to emit the audio output above the predefined noise threshold comprises an indication of whether the right speaker and the left speaker are each emitting the audio output above the predefined noise threshold.

6. The method of claim 5, wherein:

the indication of whether the device under test has the ability to emit the audio output above the predefined noise threshold generated by the device under test comprises an indication of whether the right speaker and the left speaker are each emitting audio outputs across a plurality of frequency ranges.

7. A system comprising:

a processor;

a data bus coupled to the processor; and a non-transitory, computer-readable storage medium embodying computer program code, the non-transitory, computer-readable storage medium being coupled to the data bus, the computer program code interacting with a plurality of computer operations and comprising instructions executable by the processor and configured for:

identifying a reference audio output associated with a manufacturing environment;

calibrating a threshold noise level of the manufacturing environment;

monitoring the manufacturing environment for an audio output above a predefined noise threshold, the audio output above the predefined noise threshold being generated by a device under test, the device under test being manufactured within the manufacturing environment;

comparing the audio output above the predefined noise threshold with the reference audio output; and, presenting information associated with the audio output above the predefined noise threshold upon detection of a match between the audio output above the predefined noise threshold and the reference audio output, the information associated with the audio output providing an indication of whether the device under test has an ability to emit an audio output according to predetermined criteria, the presenting being via a user interface, the user interface presenting a graphical representation of the indication of whether the device under test has the ability to emit the audio output according to the predetermined criteria.

8. The system of claim 7, wherein:

the identifying the reference audio output comprises recording a reference audio output; and, selecting a reference audio output sample from the reference audio output.

9. The system of claim 8, wherein:

the identifying the reference audio output comprises assigning a value to the reference audio output.

10. The system of claim 7, wherein:

the information associated with the audio output is presented via an audio output detection system user interface.

11. The system of claim 7, wherein:

the device under test comprises a right speaker and a left speaker; and, the indication of whether the device under test has the ability to emit the audio output above the predefined noise threshold comprises an indication of whether the right speaker and the left speaker are each emitting the audio output above the predefined noise threshold.

12. The system of claim 11, wherein:

the indication of whether the device under test has the ability to emit the audio output above the predefined noise threshold generated by the device under test comprises an indication of whether the right speaker and the left speaker are each emitting audio outputs across a plurality of frequency ranges.

13. A non-transitory, computer-readable storage medium embodying computer program code, the computer program code comprising computer executable instructions configured for:

identifying a reference audio output associated with a manufacturing environment;

calibrating a threshold noise level of the manufacturing environment;

monitoring the manufacturing environment for an audio output above a predefined noise threshold, the audio output above the predefined noise threshold being generated by a device under test, the device under test being manufactured within the manufacturing environment;

comparing the audio output above the predefined noise threshold with the reference audio output; and, presenting information associated with the audio output above the predefined noise threshold upon detection of a match between the audio output above the predefined noise threshold and the reference audio output, the information associated with the audio output providing an indication of whether the device under test has an ability to emit an audio output according to predetermined criteria, the presenting being via a user interface, the user interface presenting a graphical representation of the indication of whether the device under test has the ability to emit the audio output according to the predetermined criteria.

14. The non-transitory, computer-readable storage medium of claim 13, wherein:

the identifying the reference audio output comprises recording a reference audio output; and, selecting a reference audio output sample from the reference audio output.

15. The non-transitory, computer-readable storage medium of claim 14, wherein:

the identifying the reference audio output comprises assigning a value to the reference audio output.

16. The non-transitory, computer-readable storage medium of claim 13, wherein:

the information associated with the audio output is presented via an audio output detection system user interface.

17. The non-transitory, computer-readable storage medium of claim 16, wherein:

the device under test comprises a right speaker and a left speaker; and, the indication of whether the device under test has the ability to emit the audio output above the predefined noise threshold comprises an indication of whether the right speaker and the left speaker are each emitting the audio output above the predefined noise threshold.

18. The non-transitory, computer-readable storage medium of claim 17, wherein:

the indication of whether the device under test has the ability to emit the audio output above the predefined noise threshold generated by the device under test comprises an indication of whether the right speaker and the left speaker are each emitting audio outputs across a plurality of frequency ranges.

19. The non-transitory, computer-readable storage medium of claim 13, wherein:

the computer executable instructions are deployable to a client system from a server system at a remote location.

20. The non-transitory, computer-readable storage medium of claim 13, wherein:

the computer executable instructions are provided by a service provider to a user on an on-demand basis.

* * * * *